US009694883B1

(12) United States Patent
Bonventre

(10) Patent No.: US 9,694,883 B1
(45) Date of Patent: Jul. 4, 2017

(54) ILLUMINATED BOAT RUB RAIL

(71) Applicant: Joseph Bonventre, Mastic Beach, NY (US)

(72) Inventor: Joseph Bonventre, Mastic Beach, NY (US)

( * ) Notice: Subject to any disclaimer, the term of this patent is extended or adjusted under 35 U.S.C. 154(b) by 0 days.

(21) Appl. No.: 15/290,382

(22) Filed: Oct. 11, 2016

(51) Int. Cl.
*B63B 59/02* (2006.01)
*B63B 45/04* (2006.01)

(52) U.S. Cl.
CPC ..... *B63B 59/02* (2013.01); *B63B 45/04* (2013.01)

(58) Field of Classification Search
CPC ..... B63B 59/02
USPC ..... 114/219
See application file for complete search history.

(56) References Cited

U.S. PATENT DOCUMENTS 5,495,401 A 2/1996 Evans
5,730,079 A * 3/1998 Totty ..... B63B 45/02 114/343
6,231,217 B1 * 5/2001 Krippelz, Sr. ..... B60Q 1/32 114/15
D465,292 S 11/2002 Ko
6,474,851 B1 * 11/2002 Baley ..... A01K 79/02 114/255
6,733,161 B2 * 5/2004 Tufte ..... B60Q 1/32 293/117
6,742,916 B1 * 6/2004 Dunn ..... B60Q 1/32 114/343
6,817,731 B2 * 11/2004 Tufte ..... B60Q 1/32 362/223
6,869,202 B2 * 3/2005 Tufte ..... B60Q 1/32 362/224
6,921,184 B2 * 7/2005 Tufte ..... B60Q 1/32 362/217.07
7,291,852 B1 * 11/2007 Matlack ..... A01K 97/00 250/365
7,401,949 B2 * 7/2008 Tufte ..... B60Q 1/32 293/117
7,575,499 B2 * 8/2009 Tufte ..... G09F 13/22 362/511
8,277,098 B2 * 10/2012 Ortwein ..... B60Q 1/32 362/477
2003/0209183 A1 * 11/2003 Tufte ..... B60Q 1/32 114/343
2004/0179358 A1 * 9/2004 Tufte ..... B60Q 1/32 362/223
2010/0118557 A1 * 5/2010 Ortwein ..... B60Q 1/32 362/477
2014/0056013 A1 * 2/2014 Hancock, Jr. ..... B63B 45/04 362/477

FOREIGN PATENT DOCUMENTS

CA 2131604 A1 11/1997

* cited by examiner

*Primary Examiner* — Lars A Olson
*Assistant Examiner* — Jovon Hayes

(57) ABSTRACT

The illuminated boat rub rail is adapted for use with a water vessel. The illuminated boat rub rail is a combination rub rail and navigational lighting system that is mounted on the hull of the water vessel. The rub rail of the illuminated boat rub rail has integrated into it a plurality of lights that are used for augmented navigational and transportation purposes.

6 Claims, 5 Drawing Sheets

ILLUMINATED BOAT RUB RAIL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field signaling and lighting devices for ships and water vessels, more specifically, a navigational lighting system configured for use water vessels.

SUMMARY OF INVENTION

The illuminated boat rub rail is adapted for use with a water vessel. The illuminated boat rub rail is a combination rub rail and augmented navigational lighting system that is mounted on the hull of the water vessel. The rub rail of the illuminated boat rub rail has integrated into it a plurality of lights that are used for navigational and transportation purposes.

These together with additional objects, features and advantages of the illuminated boat rub rail will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated boat rub rail in detail, it is to be understood that the illuminated boat rub rail is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated boat rub rail.

It is therefore important that the claims be regarded as including such equivalent construction insofar as they do not depart from the spirit and scope of the illuminated boat rub rail. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
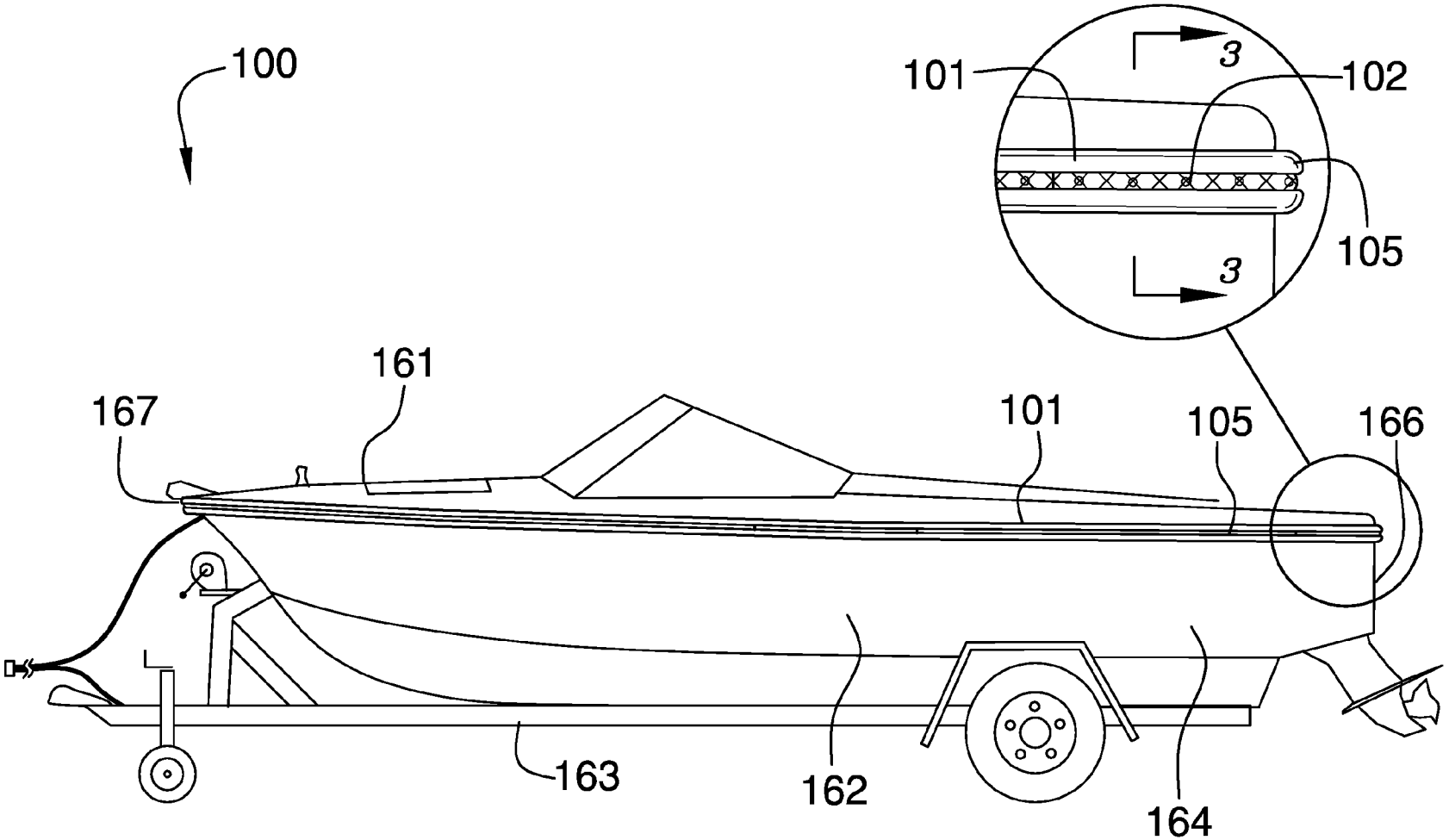
FIG. 1 is a side view of an embodiment of the disclosure.
Figure 2:
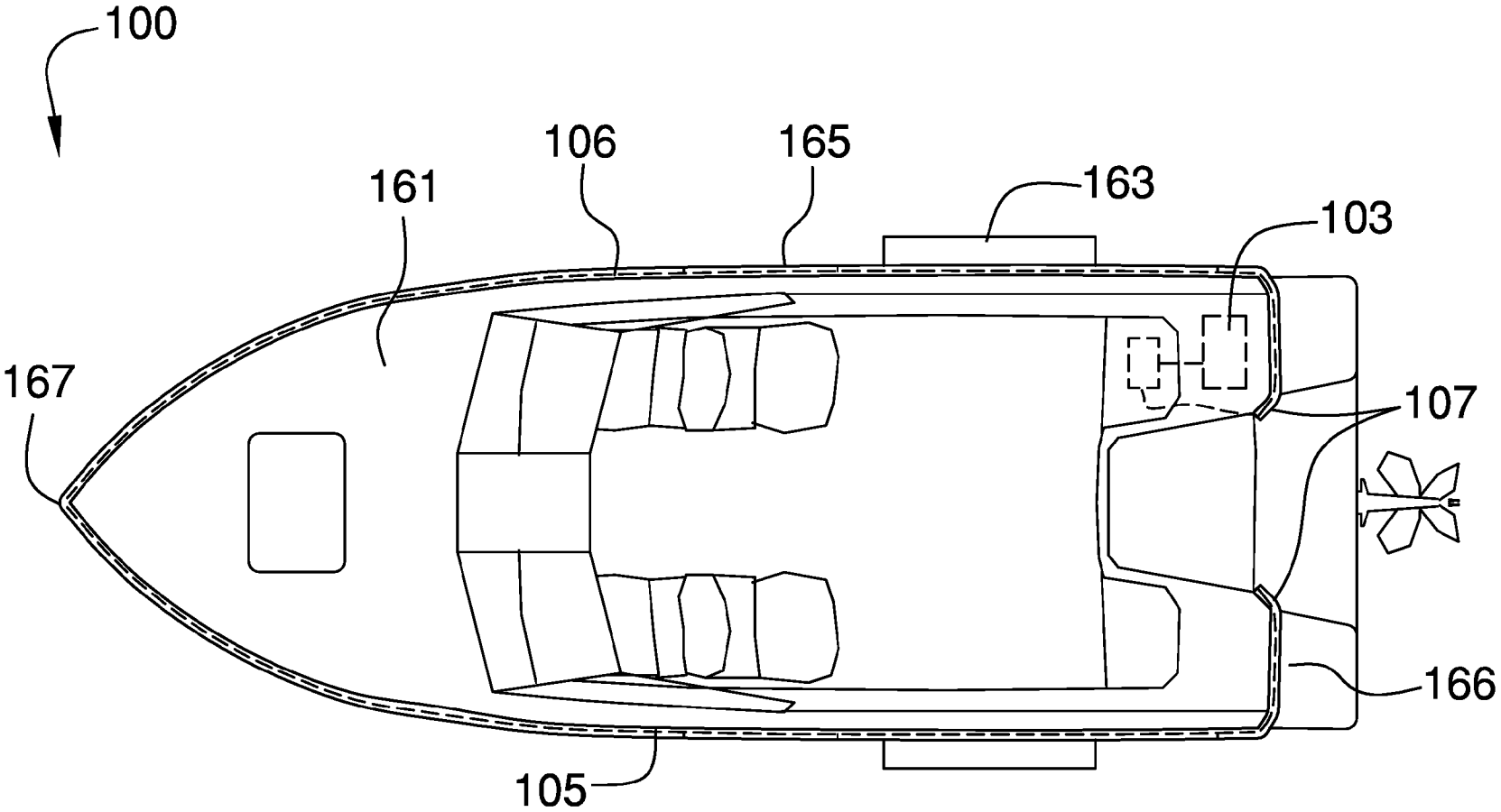
FIG. 2 is a top view of an embodiment of the disclosure.
Figure 3:
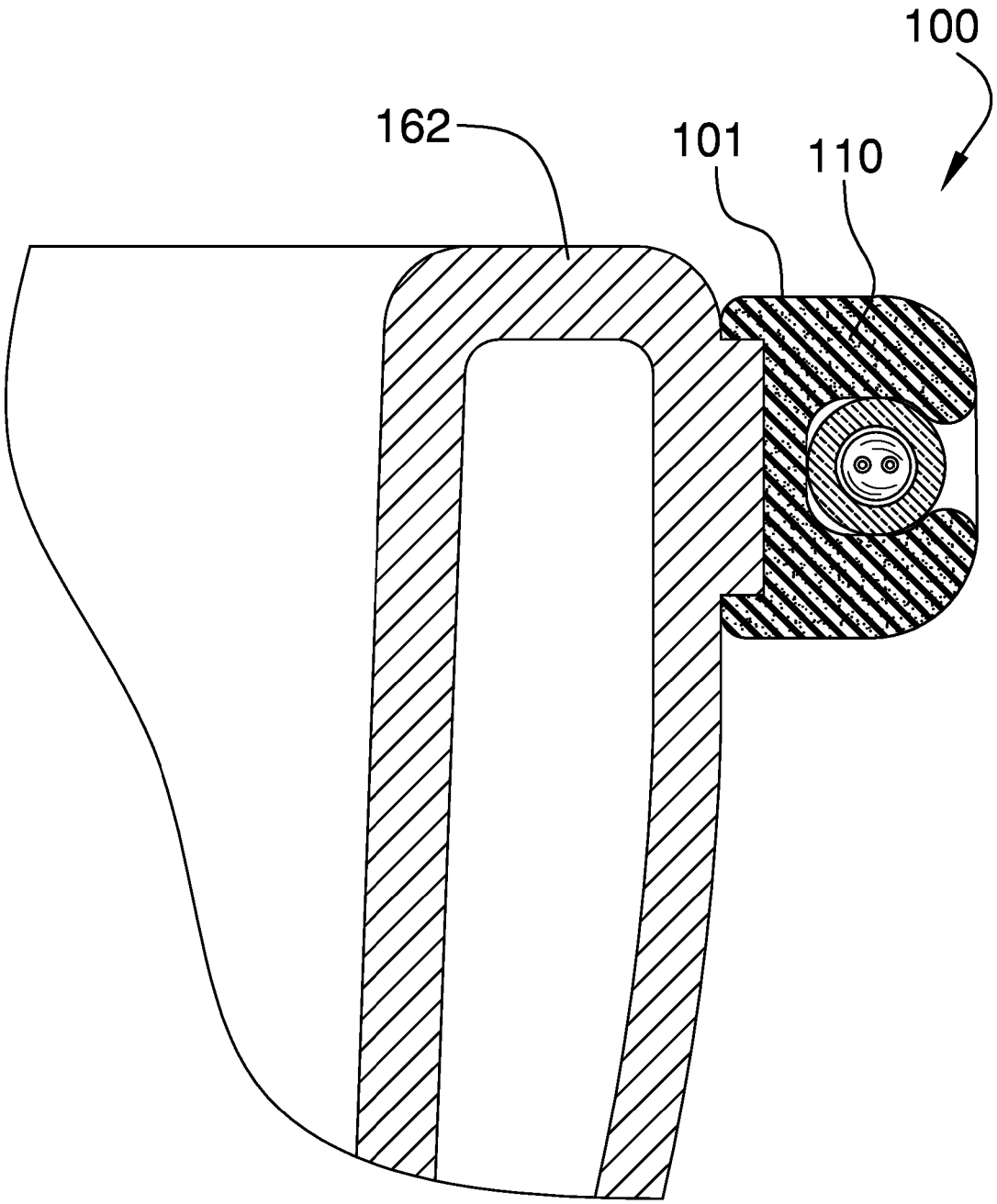
FIG. 3 is a cross-sectional view of an embodiment of the disclosure across 3-3 as shown in FIG. 1.
Figure 4:
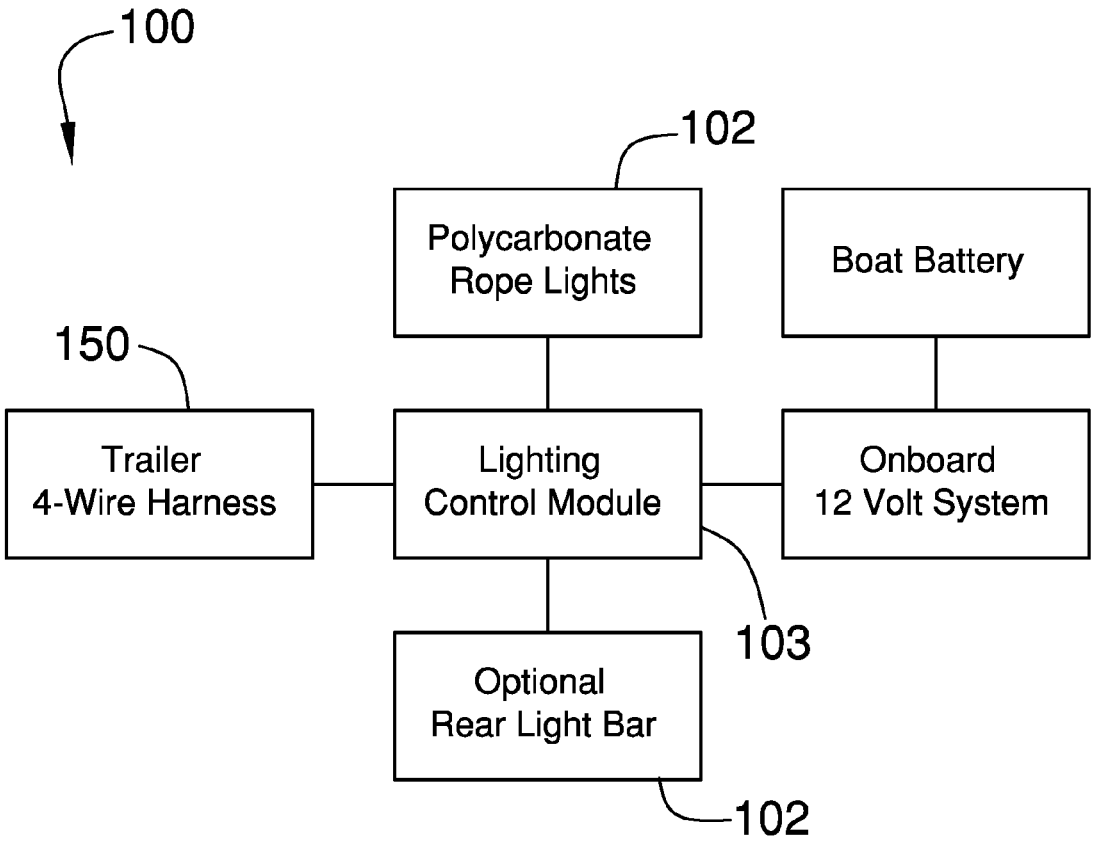
FIG. 4 is a block diagram of an embodiment of the disclosure.
Figure 5:
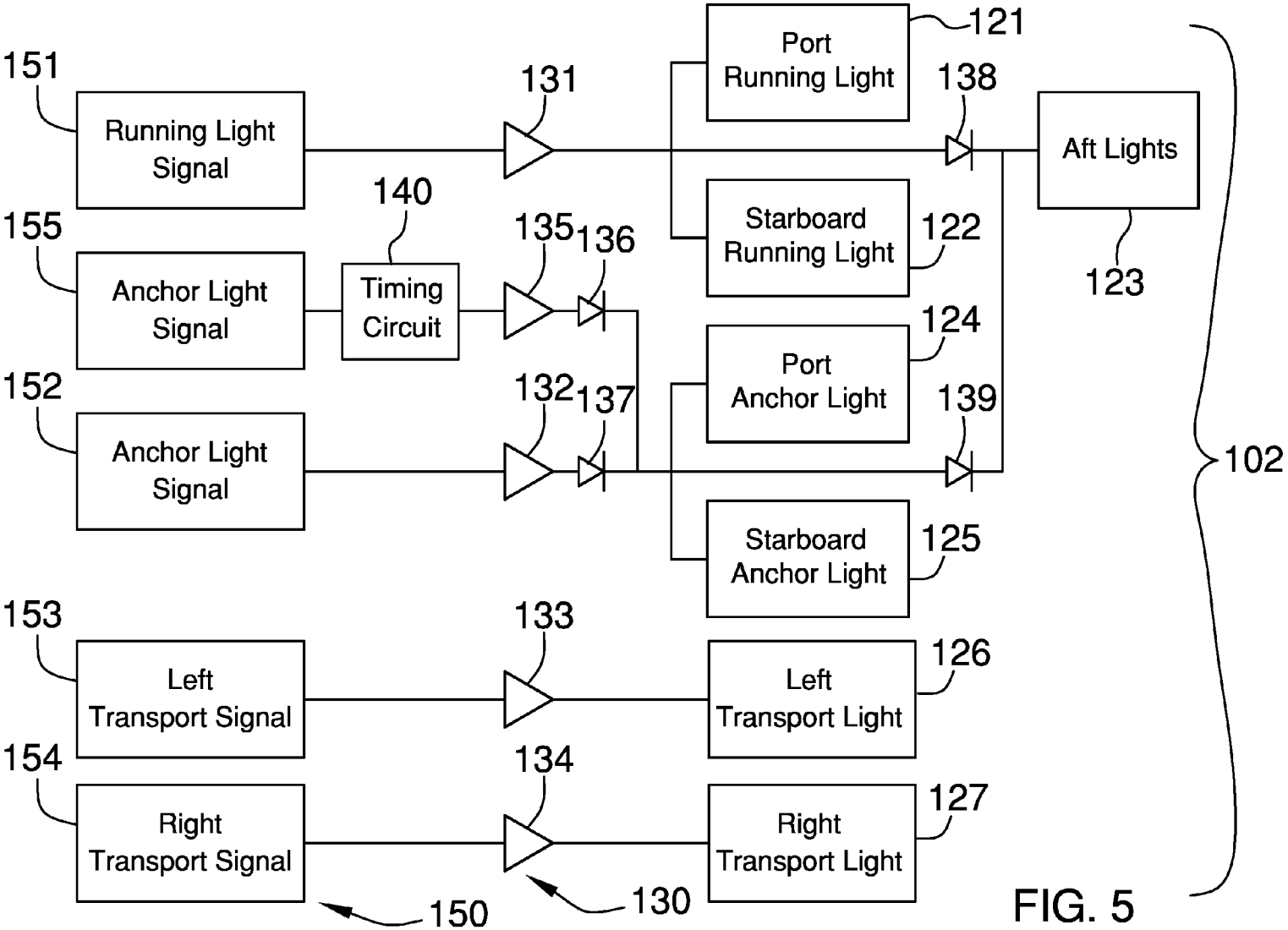
FIG. 5 is a schematic view of an embodiment of the disclosure.

Detailed reference will now be made to one or more potential embodiments of the disclosure, which are illustrated in FIGS. 1 through 5.

The illuminated boat rub rail 100 (hereinafter invention) comprises a rub rail 101, a plurality of lights 102, and a control system 103. The invention 100 is adapted for use with a water vessel 161. The invention 100 is a combination of rub rails 101 and in addition to an existing navigational lighting system that is mounted on the hull 162 of the water vessel 161. The rub rails 101 of the invention 100 have integrated into it a plurality of lights 102 that are used for augmenting the navigational and transportation purposes. The trailer 163 lighting is intended for use when the water vessel 161 is being transported over land by trailer 163. The illumination of each of the plurality of lights 102 is controlled by the control system 103.

The rub rail 101 comprises a plurality of rigid structures that are mounted on the hull 162 of the water vessel 161. The purpose of each rub rail 101 is to prevent damage to the hull 162 of the vessel caused by bumps with docks or other water vessels 161 or damage to the hull 162 caused by the rubbing against the hull 162 of ropes or other lines. Each individual rub rail 101 comprises a guard 110, and a first channel 111. The guard 110 is a structure that is attached to the hull 162 and that is intended to separate the hull 162 from the previously described sources of damage.

The rub rails 101 further comprise a port rub rail 105, a starboard rub rail 106 and an aft rub rail 107. The port rub rail 105 is attached to the port side 164 of the hull 162 of the water vessel 161 and extends from the aft side 166 to the bow 167 of the water vessel 161. The port rub rail 105 is mounted such that the plurality of lights 102 are visible. The starboard rub rail 106 is attached to the starboard side 165 of the hull 162 of the water vessel 161 and extends from the aft side 166 to the bow 167 of the water vessel 161. The starboard rub rail 106 is mounted such that the plurality of lights 102 are visible. The aft rub rail 107 is attached to the aft side 166 of the hull 162 of the water vessel 161 and extends for the port side 164 to the starboard side 165 of the water vessel 161. The aft rub rail 107 is mounted such that the plurality of lights 102 is visible.

In the first potential embodiment of the disclosure, each of the plurality of lights 102 is an organized collection of light sources of specified colors each of which are mounted in the rub rails 101. The plurality of lights 102 comprises a port running light 121, a starboard running light 122, an aft light 123, a port anchor light 124, a starboard anchor light 125, a left transport light 126, and a right transport light 127. The port running light 121 comprises a first plurality of red light sources that are mounted in the port rub rail 105. The starboard running light 122 comprises a first plurality of green light sources that are mounted in the starboard rub rail 105. The aft light 123 comprises a first plurality of white light sources that are mounted in the aft rub rail 107. The port anchor light 124 comprises a second plurality of white light sources that are mounted in the port rub rail 105. The starboard anchor light 125 comprises a third plurality of white light sources that are mounted in the starboard rub rail 106. The left transport light 126 comprises a second plurality of red light sources that are mounted in the aft rub rail 107. The right transport light 127 comprises a third plurality of red light sources that are mounted in the aft rub rail 107. The left transport light 126 and the right transport light 127 are controlled separately by the control system 103.

The purpose of the control system 103 is to operate each of the plurality of lights 102 in response to a plurality of inputs 150. Based on the signals received by the plurality of inputs 150, the control system 103 will selectively illuminate and extinguish lights selected from the plurality of lights 102. Each of the plurality of inputs 150 is a voltage that is externally provided by either the water vessel 161 or the trailer 163. The plurality of inputs 150 comprises a running light signal 151, an anchor light signal 152, a left transport signal 153, a right transport signal 154, and an emergency signal 155. The running light signal 151 is a signal received from the water vessel 161 that indicates a requirement that the plurality of lights 102 should be in the lighting configuration that is required by law for water vessels 161 that are under way in darkness. The anchor light signal 152 is a signal received from the water vessel 161 that indicates a requirement that the plurality of lights 102 should be in the lighting configuration that is required by law for water vessels 161 that are anchored in darkness. The left transport signal 153 is a signal received from the trailer 163 that indicates a requirement that the plurality of lights 102 should be in the lighting configuration that is required by law (such as stopping illumination or turn signals) for trailers 163 that are being towed in darkness. The right transport signal 154 is a signal received from the trailer 163 that indicates a requirement that the plurality of lights 102 should be in the lighting configuration that is required by law (such as stopping illumination or turn signals) for trailers 163 that are being towed in darkness. The emergency signal 155 is a signal received from the water vessel 161 that indicates a requirement that the plurality of lights 102 should be in the lighting configuration for water vessels 161 that are unable to or severely limited in the ability to maneuver.

The control system 103 comprises a plurality of buffers 130, a plurality of diodes 129 and a timing circuit 140. The each of the plurality of buffers 130 is an electric circuit that is wired to receive an input signal selected from the plurality of inputs 150 and, when the signal is received, to drive an electrical circuit that is adequate to power the illumination of the lights selected from the plurality of lights 102 that are indicated by the selected input signal. The purpose of each of the diodes 129 is to electrically isolate a buffer selected from the plurality of buffers 130 from the buffers remaining within the plurality of buffers 130. The use of the timing circuit 140 is discussed elsewhere within this disclosure.

The plurality of buffers 130 comprises a first buffer 131, a second buffer 132, a third buffer 133, a fourth buffer 134, and a fifth buffer 135. The plurality of diodes 129 comprises a first diode 136, a second diode 137, a third diode 138, and a fourth diode 139. As shown in FIG. 7, the first buffer 131 receives the running light signal 151. The first buffer 131 amplifies the running light signal 151 to illuminate the port running light 121, the starboard running light 122, and the aft light 123. The connection between the first buffer 131 and the aft light 123 is protected with the third diode 138. The second buffer 132 receives the anchor light signal 152. The second buffer 132 amplifies the anchor light signal 152 to illuminate the port anchor light 124, the starboard anchor light 125, and the aft light 123. The connection between the first buffer 131 port anchor light 124, the starboard anchor light 125, and the aft light 123 is protected with the second diode 137 and the fourth diode 139. The third buffer 133 receives the left transport signal 153. The third buffer 133 amplifies the left transport signal 153 to illuminate the left transport light 126. The fourth buffer 134 receives the right transport signal 154. The fourth buffer 134 amplifies the right transport signal 154 to illuminate the right transport light 127.

The fifth buffer 135 processes the emergency signal 155. The emergency signal 155 is initially processed through a timing circuit 140. The timing circuit 140 generates a series of electrical pulses that the fifth buffer 135 amplifies to illuminate the port anchor light 124, the starboard anchor light 125, and the aft light 123 in a flashing manner. The connection between the fifth buffer 135, the second buffer 132, the port anchor light 124, the starboard anchor light 125, and the aft light 123 is protected with the first diode 136 and the fourth diode 139.

The guard 110 may be formed from metal or from plastic. In the first potential embodiment of the disclosure, the guard 110 is molded from polyvinylchloride. The port running light 121 comprises a readily and commercially first LED rope that exclusively comprises red LEDs. The first LED rope is sized to fit in the first channel 111 of the port rub rail 105. The starboard running light 122 comprises a readily and commercially second LED rope that exclusively comprises green LEDs. The second LED rope is sized to fit in the first channel 111 of the starboard rub rail 106. The aft light 123 comprises a readily and commercially third LED rope that exclusively comprises white LEDs. The third LED rope is sized to fit in the first channel 111 of the aft rub rail 107.

The port anchor light 124 comprises a readily and commercially fourth LED rope that exclusively comprises white LEDs.

It shall be noted that the color light sources that have been defined as white, red, green or blue, may be interchanged with other colors, and may be further defined as a first color light source, a second color light source, a third light color source, a fourth light color source, etc.

The following definitions were used in this disclosure:

Diode: As used in this disclosure, a diode is a two terminal semiconductor device that allows current flow in only one direction. The two terminals are called the anode and the cathode.

LED: As used in this disclosure, an LED is an acronym for a light emitting diode. A light emitting diode is a diode that is also a light source.

Light: As used in this disclosure, a light is an electrical device that generates visible light to illuminate objects so they can be seen.

Rail: As used in this disclosure, a rail is a generic term that refers to a structure with a primary sense of direction that is perpendicular to the direction of the gravitational force.

Rub Rail: As used in this disclosure, a rub rail is a sacrificial structure that is mounted on the hull of a ship, boat, or other water vessel that protects the hull from damage by contact with another structure, such as a dock or ship, for from the potential damage that can be cause by lines rubbing against the hull.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate a continuous electrical control signal and then, after a predetermined amount of time, to discontinue or remove the said electrical control signal. In common usage, a timing circuit is also referred to as timing circuitry.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A lighting system comprising:

a rub rail, a plurality of lights, and a control system;

wherein the lighting system is adapted for use with a water vessel;

wherein the water vessel is further defined with a hull, a port side, an aft side, a starboard side, and a bow;

wherein the lighting system is adapted for use with a trailer;

wherein the plurality of lights are attached to the rub rail;

wherein the rub rail is attached to the hull;

wherein the illumination of each of the plurality of lights is controlled by the control system;

wherein the rub rail comprises a plurality of rigid structures;

wherein each individual rub rail comprises a guard, and a first channel;

wherein the guard attaches to the hull; wherein the guard has formed in it the first channel; wherein the first channel is a groove that is formed within the guard;

wherein the first channel receives and displays lights selected from the plurality of lights;

wherein the rub rails further comprise a port rub rail, a starboard rub rail and an aft rub rail;

wherein the port rub rail attaches to the port side of the hull such that a first group of lights selected from the plurality of lights are visible;

wherein the starboard rub rail attaches to the starboard side of the hull such that a second group of lights selected from the plurality of lights are visible;

wherein the aft rub rail attaches to the aft side of the hull such that a third group of lights selected from the plurality of lights are visible;

wherein each of the plurality of lights is collection of light sources of previously specified colors;

wherein each of the plurality of lights are mounted in the rub rail;

wherein the plurality of lights comprises a port running light, a starboard running light, an aft light, a port anchor light, a starboard anchor light, a left transport light, and a right transport light;

wherein the port running light comprises a first plurality of a first color light sources that are mounted in the port rub rail;

wherein the starboard running light comprises a first plurality of a second color light sources that are mounted in the starboard rub rail;

wherein the aft light comprises a first plurality of a third light color sources that are mounted in the aft rub rail;

wherein the port anchor light comprises a second plurality of a fourth light color sources that are mounted in the port rub rail;

wherein the starboard anchor light comprises a third plurality of fifth light color sources that are mounted in the starboard rub rail;

wherein the left transport light comprises a second plurality of the first light color sources that are mounted in the aft rub rail;

wherein the right transport light comprises a third plurality of the first light sources that are mounted in the aft rub rail;

wherein the control system selectively illuminates and extinguishes lights selected from the plurality of lights based on a plurality of inputs;

wherein each of the plurality of inputs is a signal that is externally provided from the group consisting of the water vessel or the trailer;

wherein the plurality of inputs comprises a running light signal, an anchor light signal, a left transport signal, a right transport signal, and an emergency signal;

wherein the running light signal is a signal received from the water vessel;

wherein the anchor light signal is a signal received from the water vessel;

wherein the left transport signal is a signal received from the trailer;

wherein the right transport signal is a signal received from the trailer;

wherein the emergency signal is a signal received from the water vessel;

wherein the control system comprises a plurality of buffers;

wherein each of the plurality of buffers is an electric circuit that is wired to receive an input signal selected from the plurality of inputs;

wherein each of the plurality of buffers drives an electrical circuit that power the illumination of lights selected from the plurality of lights;

wherein the control system comprises a plurality of diodes;

wherein each of the diodes electrically isolates a buffer selected from the plurality of buffers from the buffers remaining within the plurality of buffers;

wherein the plurality of buffers comprises a first buffer, a second buffer, a third buffer, a fourth buffer, and a fifth buffer;

wherein the first buffer receives the running light signal;

wherein the first buffer amplifies the running light signal to illuminate the port running light, the starboard running light, and the aft light;

wherein the second buffer receives the anchor light signal;

wherein the second buffer amplifies the anchor light signal to illuminate the port anchor light, the starboard anchor light, and the aft light;

wherein the third buffer receives the left transport signal;

wherein the third buffer amplifies the left transport signal to illuminate the left transport light;

wherein the fourth buffer receives the right transport signal;

wherein the fourth buffer amplifies the right transport signal to illuminate the right transport light;

wherein the plurality of diodes comprises a first diode, a second diode, a third diode, and a fourth diode;

wherein the connection between the first buffer and the aft light is protected with the third diode;

wherein the connection between the first buffer port anchor light, the starboard anchor light, and the aft light is protected with the second diode and the fourth diode.

2. The lighting system according to claim 1 wherein the port running light comprises a first LED rope that exclusively comprises red LEDs;

wherein the first LED rope is sized to fit in the first channel of the port rub rail;

wherein the starboard running light comprises a second LED rope that exclusively comprises green LEDs;

wherein the second LED rope is sized to fit in the first channel of the starboard rub rail.

3. The lighting system according to claim 2 wherein the aft light comprises a third LED rope that exclusively comprises white LEDs;

wherein the third LED rope is sized to fit in the first channel of the aft rub rail.

4. The lighting system according to claim 3 wherein the control circuit further comprises a timing circuit;

wherein the fifth buffer connects to the timing circuit;

wherein the emergency signal connects to the timing circuit.

5. The lighting system according to claim 4 wherein the timing circuit generates a series of electrical pulses;

wherein the fifth buffer amplifies the series of electrical pulses to illuminate and extinguish the port anchor light, the starboard anchor light, and the aft light.

6. The lighting system according to claim 5, wherein the connection between the fifth buffer, the second buffer, the port anchor light, the starboard anchor light, and the aft light is protected with the first diode and the fourth diode.

* * * * *